United States Patent [19]

Yoneda et al.

[11] Patent Number: 5,075,515

[45] Date of Patent: Dec. 24, 1991

[54] TRACK FOR A VEHICLE RACING GAME

[75] Inventors: Yousuke Yoneda; Akimitsu Kawasaki, both of Tokyo, Japan

[73] Assignee: Tomy Company, Ltd., Tokyo, Japan

[21] Appl. No.: 599,854

[22] Filed: Oct. 19, 1990

[30] Foreign Application Priority Data

Oct. 25, 1989 [JP] Japan ..... 1-124776[U]

[51] Int. Cl.[5] ..... A63H 18/00

[52] U.S. Cl. ..... 191/22 C; 238/10 F; 446/446; D21/143

[58] Field of Search ..... 238/10 R, 10 A, 10 B, 238/10 E, 10 F, 11, 12; 446/444, 446, 455; D21/131, 143; 104/305, DIG. 1; 191/22 C

[56] References Cited

U.S. PATENT DOCUMENTS 3,402,503 9/1968 Glass et al. ..... 238/10 F X
3,453,970 7/1968 Hansen ..... 446/446
3,948,520 4/1976 Barlow ..... 446/446 X

FOREIGN PATENT DOCUMENTS 2130494 6/1984 United Kingdom ..... 238/10 R

OTHER PUBLICATIONS

Tyco Industries Inc., #93-8-650, Racing Accessories, 1987.

*Primary Examiner*—Frank E. Werner
*Assistant Examiner*—James Eller
*Attorney, Agent, or Firm*—Staas & Halsey

[57] ABSTRACT

The present invention provides a track for a vehicle racing game. The track has two vehicle guide rails on an upper surface. At a curved section of the track, the guide rails converge so that the vehicles will collide with each other if the game operators do not pay close attention. Also, at the curved section, an inner side of the upper surface is recessed to hold the vehicle to the track. A guard member next to an outer side of the upper surface keeps the vehicle from tail sliding or spinning. A pair of power supply rails run on the upper surface along each guide rail, except in the curved section where the power supply rails connect by a wire or the like instead of running on the upper surface.

10 Claims, 5 Drawing Sheets

TRACK FOR A VEHICLE RACING GAME

BACKGROUND OF THE INVENTION

1. Field of the Invention

The present invention relates to a racing game, and more particularly, relates to a track for a racing game which permits the game's player to be satisfied with reality and thrill.

2. Description of Related Art

The racing game is a game that can be enjoyed by many generations from children to adults. In the racing game, one or more vehicles compete with each other for speed or ranking while traveling on a prefabricated track.

FIG. 6 illustrates a conventional racing game. This conventional racing game is provided with a track 1 and vehicles 2 capable of traveling on the track 1. The track 1 is constituted by connecting track plates, including straight track plates 1*a*, curved track plates 1*b* and terminal track plates 1*c*. On the upper surface of the track 1 there are formed two guide slots 3 in parallel with each other throughout the entire circumference. On each side of each guide slot 3, a pair of power supply rails 4 are run for the supply of electric power.

Each vehicle 2 is provided on the lower side of its front portion with a guide pin (not shown) for fitting in the guide slot 3. Each vehicle 2 is also provided on the lower side of its front portion with a pair of terminal strips (not shown) which come into resilient abutment with the pair of power supply rails 4. Moreover, a motor (not shown) is mounted in the vehicle 2 and is operated by electric power supplied through the terminal strips. Further, the vehicle 2 is provided on the lower side of its rear portion with a magnet (not shown) for attraction of the vehicle 2 relative to the paired power supply rails 4.

In FIG. 6, power pack 5 contains a transformer for providing power to the track via terminal track plates 1*c*. Controllers 6 control the power to the vehicles 2 on the track 1.

For playing a game using the above described racing game, each vehicle 2 is put on the track 1 while making adjustment to fit the guide pin of the vehicle in the guide slot 3. At this time, the paired terminal strips of the vehicle 2 are brought into abutment with the paired power supply rails 4. Further, the vehicle 2 is attracted to the paired power supply rails 4 by the magnet attached to the vehicle.

If in this state a throttle valve of the controller 6 is operated, a voltage having a magnitude corresponding to the degree of throttle operation is applied to the power supply rails 4. The motor operates through the vehicle's terminal strips which are in contact with the rails 4 resulting in that the wheels are driven and the vehicle 2 travels against the magnetic force of the magnet.

In the track device used in such a conventional racing game system, however, since the two parallel guide slots 4 are spacedly formed from each other throughout the entire circumference so that two vehicles traveling in parallel do not contact each other, it is not necessary for the game operator to pay attention to uncertain accidents such as contact and wedging of one vehicle with respect to another vehicle. Basically, although the game is a racing game, each game operator only needs to pay attention to controlling the speed of their own vehicle 2.

In the above track device for a racing game, moreover, the power supply rails 4 are laid around the entire circumference of the track 1 and electric power is continuously supplied to the vehicle 2. The vehicle 2 is attracted to the rails 4 around the entire circumference by the action of the magnet, and therefore, the vehicle 2 stably travels around the entire circumference of the track 1 without tail slide or getting stuck from loss of power. If the power supply rails 4 were removed, the vehicle 2 would tail slide and get stuck from loss of power. However, such tail slide at a curved portion or getting stuck does not occur in actual racing. As a result, the racing game lacks reality and thrill.

SUMMARY OF THE INVENTION

The present invention has been accomplished in view of the above-mentioned points and has an object thereof to provide a racing game rich in reality and thrill.

Another object of the present invention is to provide a racing game where the game operator must consider vehicle collisions when controlling speed.

An additional object of the present invention is to provide a racing game where the operator needs to be less concerned with vehicle tail slide or spin on a curve.

A further object of the present invention is to provide a track where the vehicle will not become disengaged from the guide slots.

According to the above objects and features of the present invention, a track is provided for a racing game of a vehicle having a motor mounted therein. A guide pin is suspended form the lower side of a front portion of the vehicle, and a magnet is attached to the lower side of a rear portion of the vehicle. The track includes guide slots formed in parallel with each other, the guide pin of the vehicle fitting in an associated one of the guide slots. The guide slots converge over at least one curved section of the track. The track also includes power supply rails for supplying electric power to the motor, the vehicle being allowed to travel by the application of voltage to the power supply rails. The vehicle's magnet is magnetically attracted to the power supply rails and comes into attractive contact therewith. The power supply rails are interrupted by terminating and commencing over the curved section of the track. A guard member attaches to the outside of the track along the curved or interrupted section to prevent spin of the vehicle. The spacing between the guide slots in the curved or interrupted section is narrower than the vehicle width. Power supply rails which are interrupted over the curved section are correspondingly connected with each other by wires or the like.

Since the power supply rails are interrupted at the curved or interrupted section, electric power is not supplied to each vehicle at this rail cutout area and hence the vehicle is allowed to travel by inertia. The inertial traveling distance depends on an incoming speed of the vehicle. If the vehicle incoming speed is too low, the vehicle will get stuck in the interrupted section of the power supply rails. As a result, there arises the necessity of also considering the controlled speed so that the vehicle will not get stuck in the interrupted section, and hence a more challenging operation becomes necessary.

Additionally, in the interrupted section, the vehicle is not attracted to the power supply rails, so that the rear portion of the vehicle is shifted to the outside of the track by centrifugal force; that is, tail slide occurs. This tail slide or spin of the vehicle is prevented by the guard member.

Moreover, since the spacing between the guide slots is narrower than the vehicle width in the interrupted section, it is necessary for the racing game operator to avoid contact or collision of the vehicles with each other before entering this section. Thus, a more challenging operation is required and hence it is possible to enjoy the game with more reality and thrill.

Further, in the racing game, because in the interrupted section the power supply rails corresponding to one another are electrically connected to each other by wires or the like, all plates of the track are powered from both ends. Therefore, it is possible to provide two or more interrupted sections of the power supply rails on the track without some electrically floating track sections. Thus, according to the track for the racing game of the present invention, it is possible to enjoy the game rich in reality and thrill.

BRIEF DESCRIPTION OF THE DRAWINGS

These and other aspects of the present invention will become apparent from the following description with reference to the drawings in which.

A racing game system according to an embodiment of the present invention will be described hereinunder with reference to the drawings.

DESCRIPTION OF THE PREFERRED EMBODIMENTS

Figure 1:
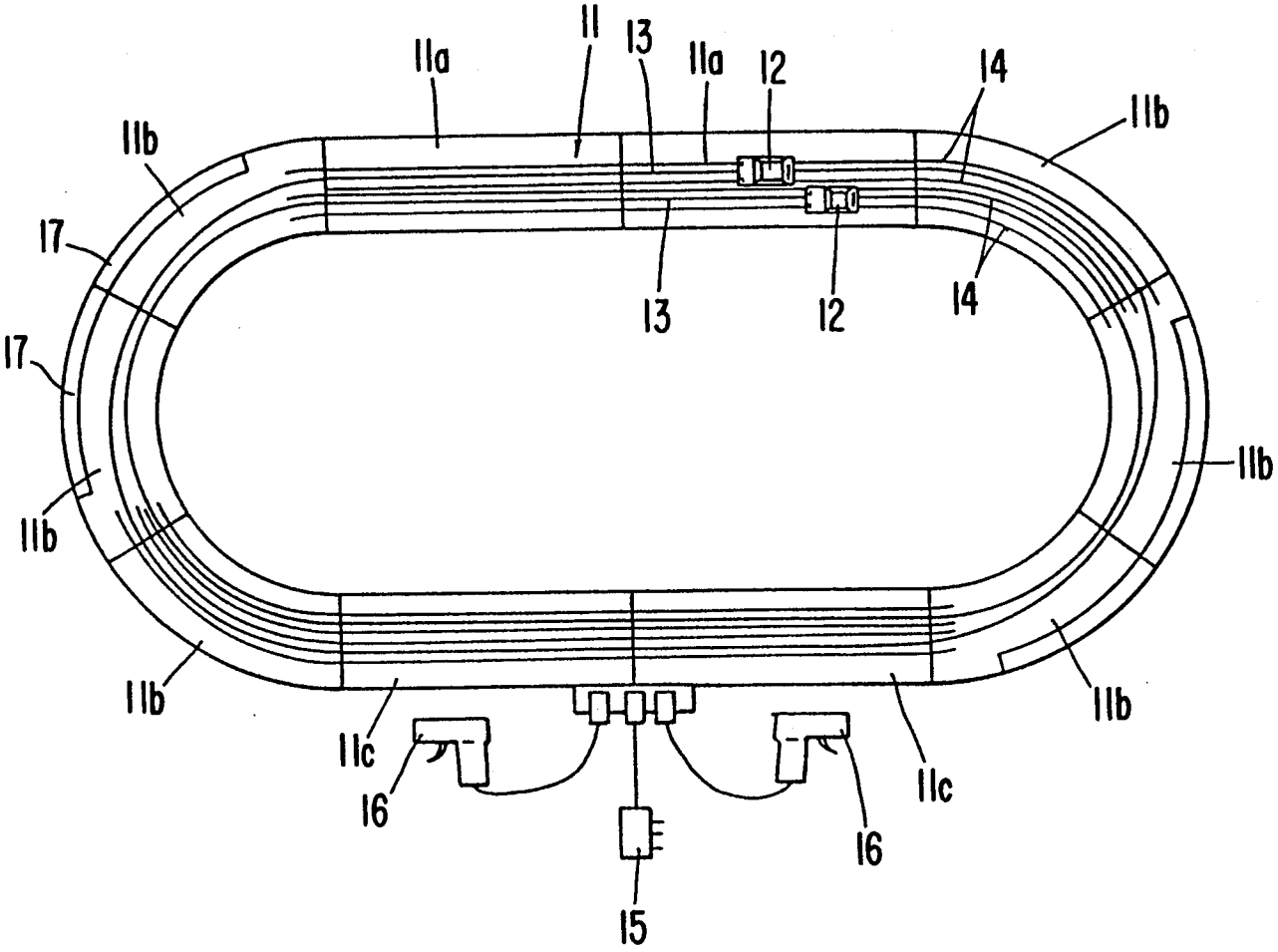
FIG. 1 is a plan view of a racing game to which is applied the track of the present invention.

FIG. 1 shows an outline of a racing game system to which is applied the track of an embodiment of the present invention. The racing game illustrated is provided with a track 11 and vehicles 12 capable of traveling on the track 11. The track 11 is constituted by connecting track plates such as straight track plate 11*a*, curved track plate 11*b* and terminal track plates 11*c* in an appropriate manner. On the upper surface of the track 11 there are formed two parallel guide slots 13 throughout the entire circumference. At two sections—a first curved section and a third curved section—at opposite corners of the track 11, the spacing between the parallel guide slots 13 is narrower than elsewhere to allow collision between the vehicles 12. Further, a pair of power supply rails 14 are laid on both sides of each guide slot 13, but are interrupted at the above first and third curved sections.

Figure 2:
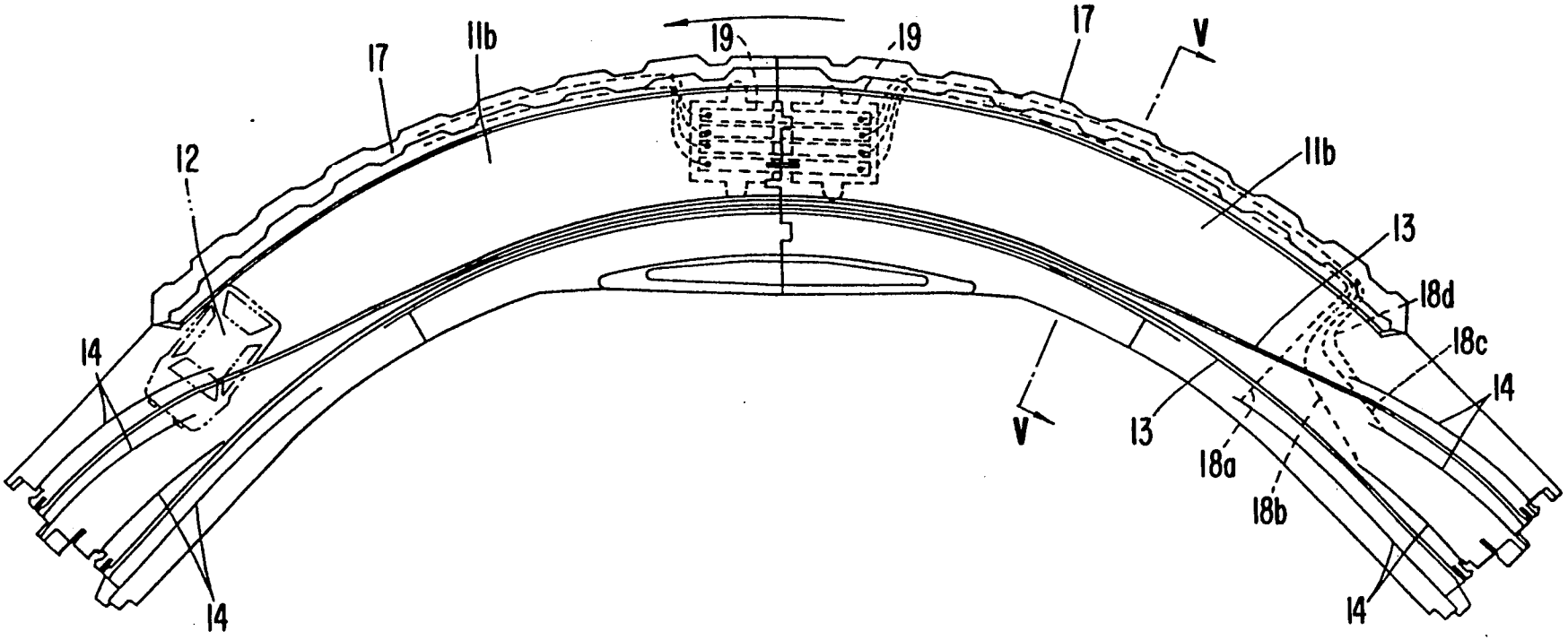
FIG. 2 is a plan view showing a principal portion thereof.

The first and third curved sections are each constituted by two interconnected curved track plates 11*c*. The two curved track plates 11*b* will be explained below in detail with reference to FIG. 2. At a middle portion of each curved section, constituted by the two curved track plates 11*c*, the spacing between the guide slots 13 is narrow to the extent that vehicles 12 collide with each other, as shown in FIG. 2. In this middle portion, the spacing between the guide slots 13 is narrower than the vehicle width, and the power supply rails 14 are interrupted. Further, a guard member 17 imitating a fence or a precipice is integrally attached to the outside of the said middle portion of the two track plates 11*b*. A guard member can also be attached to the inside of said middle portion of the track plates 11*b*.

In the case where the power supply rails 14 are interrupted at two or more portions of the loop shaped track 11, an electrically floating zone occurs in the rails 14. But in a further embodiment, the two track plates 11 electrically connect with each other to prevent the formation of an electrically floating zone.

More particularly, without interruption of the power supply rails, voltage is applied to the power supply rails 14 provided form the terminal track plates 11*c* connected to transformer 15. But in the case where the power supply rails are interrupted at two or more portions of the loop shaped track 11, some portion of the rails 14 is not connected to the rail portion 14 provided on the terminal track plate 11*c* and electric power is not supplied to the vehicle 12 in that portion. In this case, the vehicle 12 is magnetically attracted to the power supply rails 14 present in the floating zone by action of the vehicle's magnet, so that travel of the vehicle stops completely. In this embodiment, to avoid this inconvenience, the power supply rails 14 corresponding to one another through the interrupted section are electrically connected with each other by a wire or the like rather than the power supply rails. The wire can run below the upper surface or inside the guard member.

Figure 3:
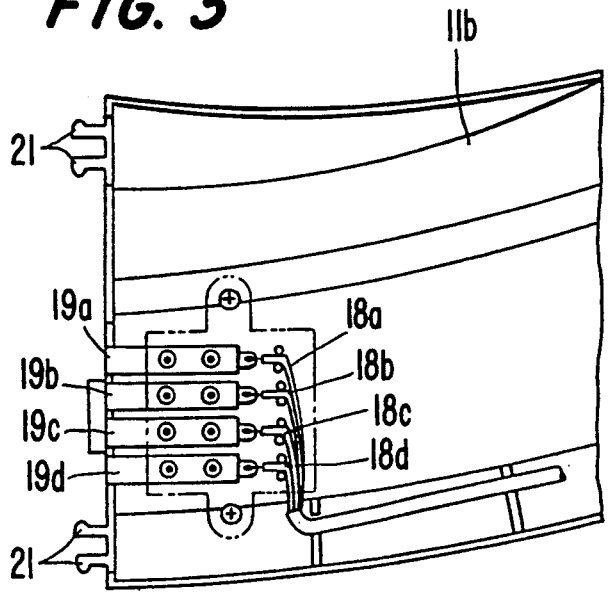
FIG. 3 is an enlarged view showing an end portion of a track plate on which power supply rails are interrupted.
Figure 4A:
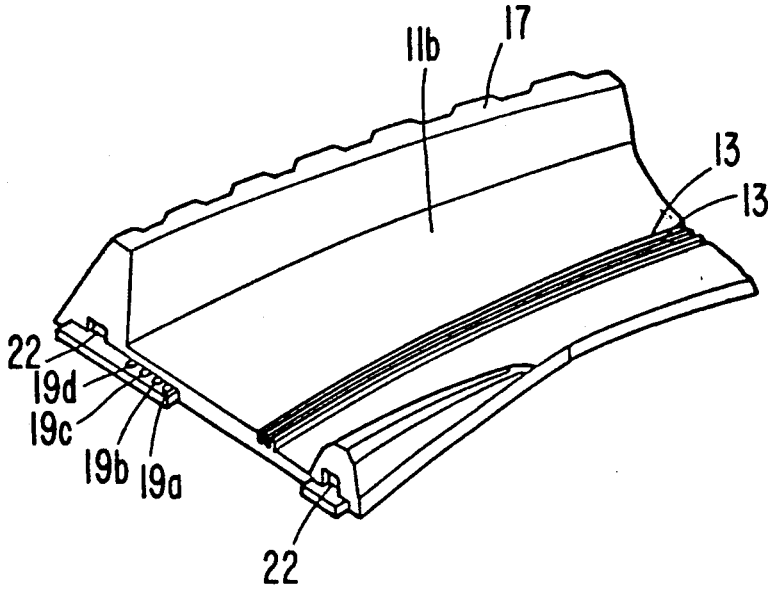
FIG. 4(A) is a perspective view showing an end portion of one track plate on which power supply rails are interrupted.
Figure 4B:
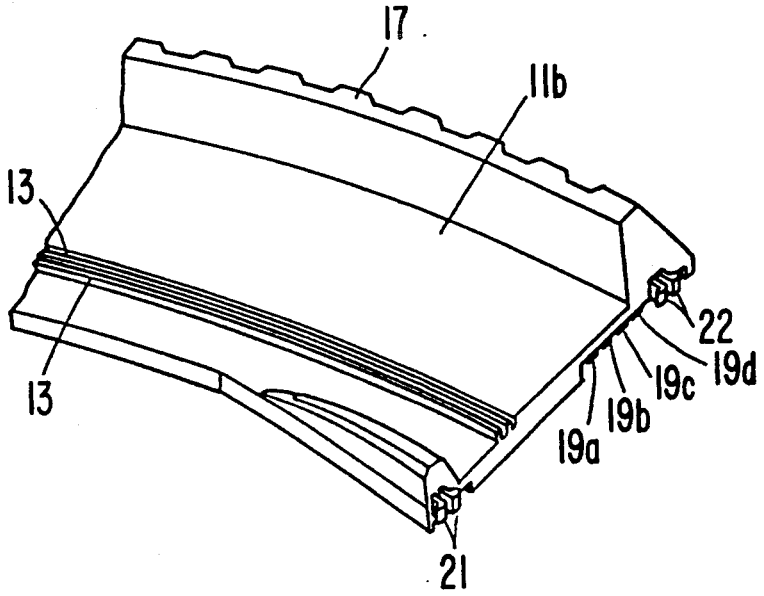
FIG. 4(B) is a perspective view showing an end portion of the other track plate on which power supply rails are interrupted.
Figure 6:
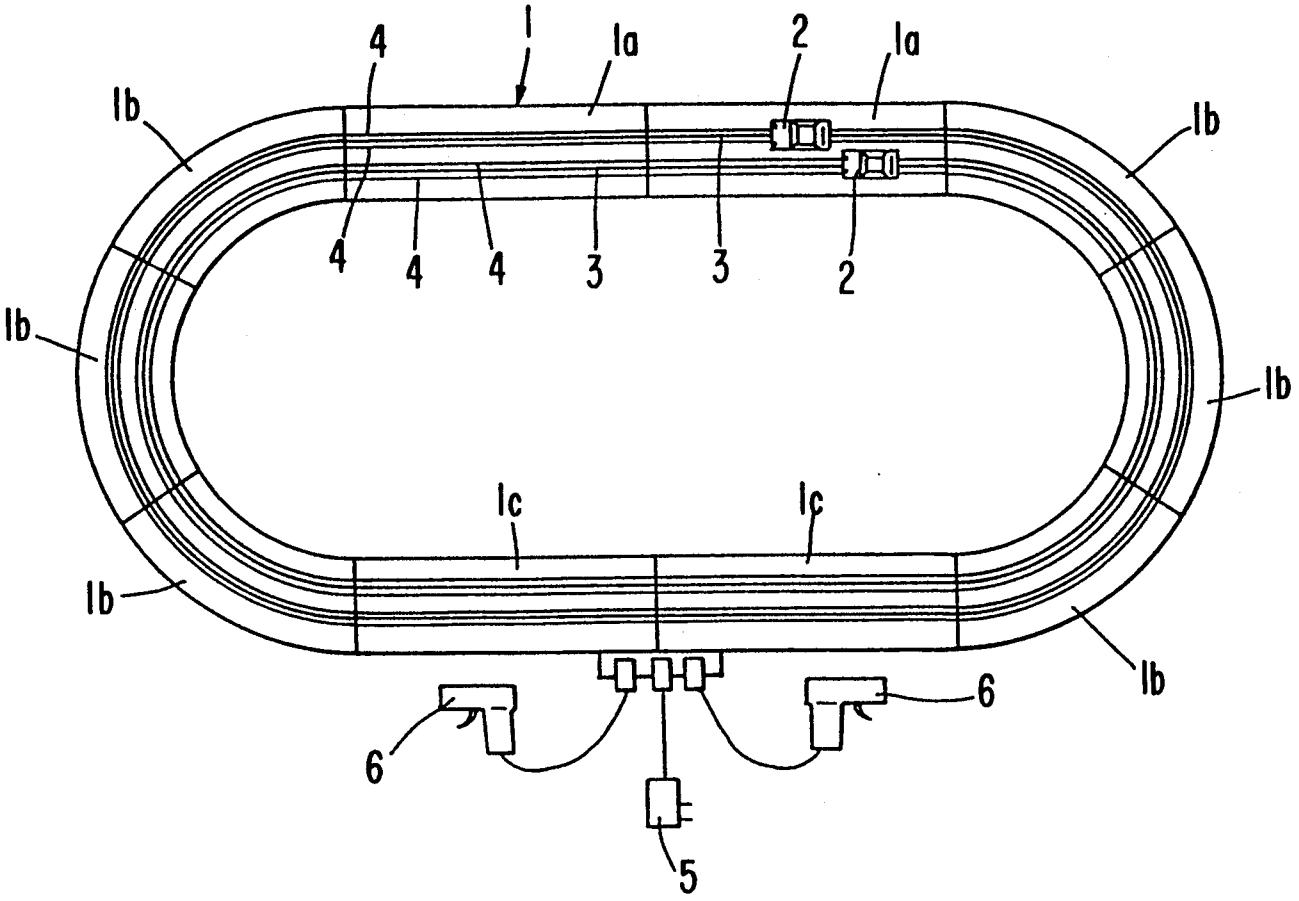
FIG. 6 (PRIOR ART)
FIG. 6 is a plan view of the whole of a conventional racing game system.

More specifically, as shown in FIGS. 3, 4(A), and 4(B), the power supply rails 14, corresponding to one another through the interrupted section, are electrically connected with each other by conductors 18*a*, 18*b*, 18*c*, 18*d* corresponding to the rails 14 and also by a connector 19.

The connector 19, which is shown on an enlarged scale in FIG. 3, is composed of terminal strips 19*a*, 19*b*, 19*c* and 19*d*. In connecting two track plates 11*b*, the corresponding terminal plates 19*a*, 19*b*, 19*c* and 19*d* are contacted with each other through engagement between resilient lugs 21 and fitting holes 22.

Figure 5A:
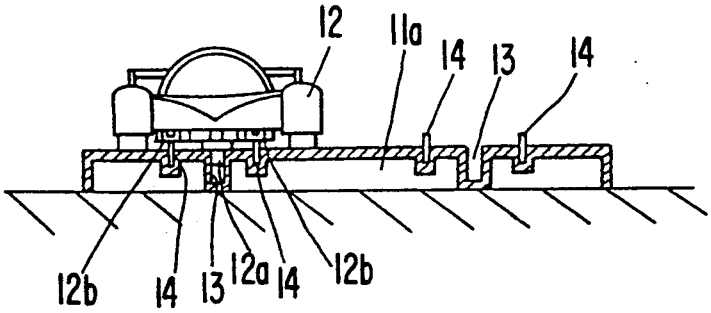
FIG. 5(A) is a vertical sectional view showing a traveling state of a vehicle on a straight track.

As shown in FIGS. 5(A) and (B), the vehicle 12 is provided on the lower side of its front portion with a guide pin 12*a* which fits in the slot 13. The vehicle 12 is also provided with terminal strips 12*b* which are brought into resilient abutment with the power supply rails 14. The vehicle's motor (not shown) is mounted in the vehicle 12 and is operated by electric power supplied through the terminal strips 12*b*. The vehicle 12 is further provided on the lower side of its rear portion with a magnet (not shown) for magnetically attracting the vehicle 12 to the power supply rails 14.

Figure 5B:
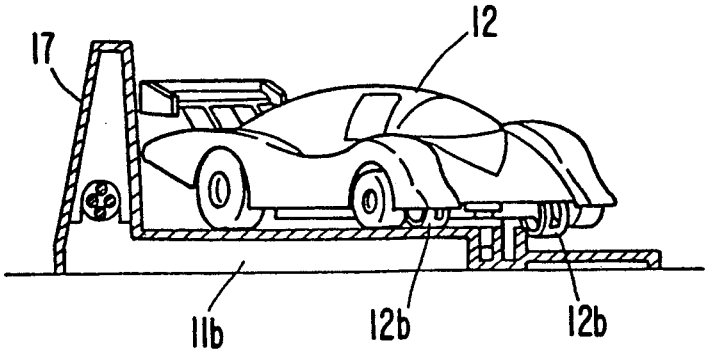
FIG. 5(B) is a vertical sectional view showing a traveling state of the vehicle on a straight track.

In FIG. 1, the reference numeral 15 denotes a power pack containing a transformer, and the numeral 16 denotes a controller. Thus, in the racing game system of this embodiment, the terminals trips 12*b* which are brought into resilient abutment with the power supply rails 14 are provided on the lower side of the front portion of the vehicle 12, so when the vehicle 12 is no longer attracted to the power supply rails 14 in the interrupted section, it is possible that the vehicle 12 will be disengaged from the guide slot 13. Therefore, as shown in FIG. 5(B), the upper surface on the innermost side of the innermost guide slot 13 is recessed or rendered a little smaller in height.

For playing the racing game using the racing game track thus constructed, the vehicle 12 is put on the track 11 while the guide pin 12*a* of the vehicle 12 is in the guide slot 13. At this time, the terminal strips 12*b* of the vehicle 12 are brought into resilient abutment with the power supply rails 14, and the vehicle 12 is attracted to the rails 14 by the action of the magnet attached to the vehicle.

When in this state, a throttle valve of the controller 16 is operated, a voltage having a magnitude corresponding to the operation of the throttle valve is applied to the power supply rails 14, whereby the motor is operated through the terminal strips 12*b* which are in contact with the rails 14, thereby causing the vehicle 12 to travel.

In the racing game using the track constructed as above, since the spacing between the two parallel guide slots 13 is narrow to the extent the vehicles 12 contact or collide with each other, it is necessary for the operator to avoid such an accident. Thus, more challenging operation of the game is required than in the conventional racing game system in which it is sufficient for the operator to pay attention to the control of speed of only the operator's own vehicle 12.

In the racing game track of this embodiment, moreover, since the power supply rails 14 are interrupted, electric power is not supplied to the vehicle 12 in the interrupted seciton. And in this area with power not supplied to the vehicle 12, the vehicle travels by inertia. The distance of this inertial travel depends on an incoming speed of the vehicle 12. Therefore, if the vehicle incoming speed is low, the vehicle 12 will get stuck in the interrupted section. Consequently, in controlling the speed for avoiding the contact and collision of the vehicles 12 with each other, there arises the necessity of also considering the controller of the vehicle so that the vehicle will not get stuck in the interrupted section, and thus a more complicated operation is required.

Additionally, in the interrupted section, the vehicle 12 is not attracted to the power supply rails 14, so that the rear portion of the vehicle is shifted to the outside of the track 11 by centrifugal force; that is, tail slide occurs. This tail slide or spin of the vehicle 12 is prevented by the guard member 17. Thus, the racing game using the track of the invention permits the operator to enjoy the game rich in reality and thrill.

According to the present invention as described above, since the power supply rails are interrupted at the curved section, electric power is not supplied to the vehicle where the rails are interrupted, so that the vehicle travels by inertia. The distance of this inertial travel depends on an incoming speed of the vehicle. If the vehicle incoming speed is too low, the vehicle will get stuck in the interrupted section of the rails. As a result, there arises the necessity of also considering the controlled speed so that the vehicle will not get stuck in the interrupted section, and a more complicated operation is required.

Additionally, in the interrupted section, the vehicle is not attracted to the power supply rails. Consequently, the vehicle undergoes the action of a centrifugal force and the rear portion thereof is shifted to the outside of the track; that is, tail slide occurs. The tail slide or spin of the vehicle is prevented by the guard member.

In the racing game using this track, moreover, plural guide slots are formed in parallel so as to permit simultaneous traveling of plural vehicles and, in the curved or interrupted section, the spacing between adjacent guide slots is narrower than the vehicle width, so operator attention is required to avoid contact or collision of vehicles with each other before entering of the vehicles into the interrupted section. That is, a more complicated operation is required and so the operator can enjoy the game with more reality and thrill.

Further, according to the racing game using this track, since the power supply rails corresponding to one another across the foregoing interrupted section are electrically connected with each other by wires or the like, an electrical floating zone is not formed, and it is possible to provide two or more such rail cutout portions on the track. Thus, the racing game using the track of the present invention permits the operator to enjoy the game with reality and thrill.

What is claimed is:

1. A track for a game for racing a vehicle, said track comprising:

a continuous upper surface having a plurality of guide slots in the continuous upper surface said guide slots running continuously beside one another and longitudinally along said continuous upper surface, a continuously running spacing between at least two of said guide slots narrowing at a first portion of said continuous upper surface and diverging at a second portion of said continuous upper surface relative to a direction the guide slots run along aid continuous upper surface; and a plurality of pairs of power supply rails, each aid guide slot associated with one pair of said power supply rails, said power supply rails running in parallel, spaced relationship with said guide slots and one another before the spacing between said guide slots narrow at the first potion and after the spacing between said guide slots diverge at the second portion, at least two pair of said power supply rails terminate at the first portion and commence at the second portion.

2. A track according to claim 1, wherein said track further comprises a plurality of conductors electrically connecting said power supply rails terminating at the first portion with corresponding power supply rails commencing at the second portion.

3. A track according to claim 2, wherein said continuous upper surface is composed of a plurality of plates, each plate comprising:

mechanical connectors on each plate attaching adjoining plates and forming said continuous upper surface; and electrical connectors electrically connecting said conductors with conductors of adjoining plate sections.

4. A track according to claim 2, wherein said continuous upper surface is composed of a plurality of plates, the first and second portions each contained indifferent adjoining plates, said plates containing the fist and second portions comprising electrical connectors electrically connecting said conductors with conductors of adjoining plate sections.

5. A track according to claim 1, wherein said continuous upper surface is composed of a plurality of plates, the fist and second portions are each contained in different adjoining plates.

6. A track according to claim 1, wherein said continuous upper surface is composed of a plurality of plates having connectors on each end attaching adjoining plates and forming said continuous upper surface.

7. A track according to claim 6, wherein the first and second portions are each contained in different adjoining plates.

8. A track according to claim 7, wherein said connectors mechanically and electrically connect adjoining plates.

9. A track according to claim 1, wherein said guide slots, before the narrowing of the spacing at the first portion and after the diverging of the spacing at the second portion, run in parallel, spaced relationship with one another.

10. A track according to claim 9, wherein the spacing narrows to a width narrower than a width of he vehicle.

* * * * *

UNITED STATES PATENT AND TRADEMARK OFFICE

CERTIFICATE OF CORRECTION

PATENT NO. : 5,075,515

DATED : December 24, 1991

INVENTOR(S) : Yousuke Yoneda, et al

It is certified that error appears in the above-identified patent and that said Letters Patent is hereby corrected as shown below:

Col. 3, lines 61 and 62, the word "section-s" is ungrammatically hyphenated and should read --sections--.

Col. 4, line 47, "19b" should be --19b,--;
line 48, ", 19c" should be --19c--.

Col. 6, line 27, "surface said guide" should be --surface, said guide--;
line 34, "aid" should be --said--;
line 36, "aid" should be --said--;
line 41, "potion" should be --portion--;
line 62, "indifferent" should be --in different--.

Signed and Sealed this

Thirtieth Day of March, 1993

*Attest:*

STEPHEN G. KUNIN

*Attesting Officer*

*Acting Commissioner of Patents and Trademarks*